United States Patent [19]

Frazer

[11] Patent Number: 5,022,567

[45] Date of Patent: Jun. 11, 1991

[54] FUNNEL AND INTEGRATED FUNNEL/CONTAINER PACKAGE

[76] Inventor: John S. Frazer, P.O. Box 885, Barnegat Light, N.J. 08006

[21] Appl. No.: 339,771

[22] Filed: Apr. 18, 1989

[51] Int. Cl.[5] ..... B65D 83/00; B65D 25/40

[52] U.S. Cl. ..... 222/475; 222/538; 222/570; 220/85 SP

[58] Field of Search ..... 222/460, 461, 475, 538, 222/539, 566, 567, 568, 570; 220/85 SP; 141/343; 215/317, 320

[56] References Cited

U.S. PATENT DOCUMENTS

| | | | |
|---|---|---|---|
| 2,375,248 | 5/1945 | Reese | 220/85 SP |
| 2,673,664 | 3/1954 | Boysen | 222/484 |
| 3,708,092 | 1/1973 | Frazer | 222/567 |
| 4,125,207 | 11/1978 | Ernst et al. | 222/538 |
| 4,241,855 | 12/1980 | Yoshioka | 222/570 |
| 4,570,273 | 2/1986 | Antos et al. | 220/85 SP |
| 4,664,301 | 5/1987 | Hoyt | 222/567 |
| 4,811,870 | 3/1989 | Bianco | 222/570 |

FOREIGN PATENT DOCUMENTS

| | | | |
|---|---|---|---|
| 724462 | 8/1942 | Fed. Rep. of Germany | 220/85 SP |
| 2138642 | 3/1972 | Fed. Rep. of Germany | 222/566 |
| 7315932 | 11/1973 | Netherlands | 220/85 SP |

*Primary Examiner*—Robert P. Olszewski
*Assistant Examiner*—Steve Reiss
*Attorney, Agent, or Firm*—John D. Kaufmann

[57] ABSTRACT

A funnel of generally U-shaped cross section is provided for use with a container to form an integrated funnel/container package wherein the funnel is designed to fit inside the opening of the container. The funnel and container may be provided with mating fastening means and the funnel may have funnel alignment means for alignment of the funnel on the container.

12 Claims, 4 Drawing Sheets

FIG. 1
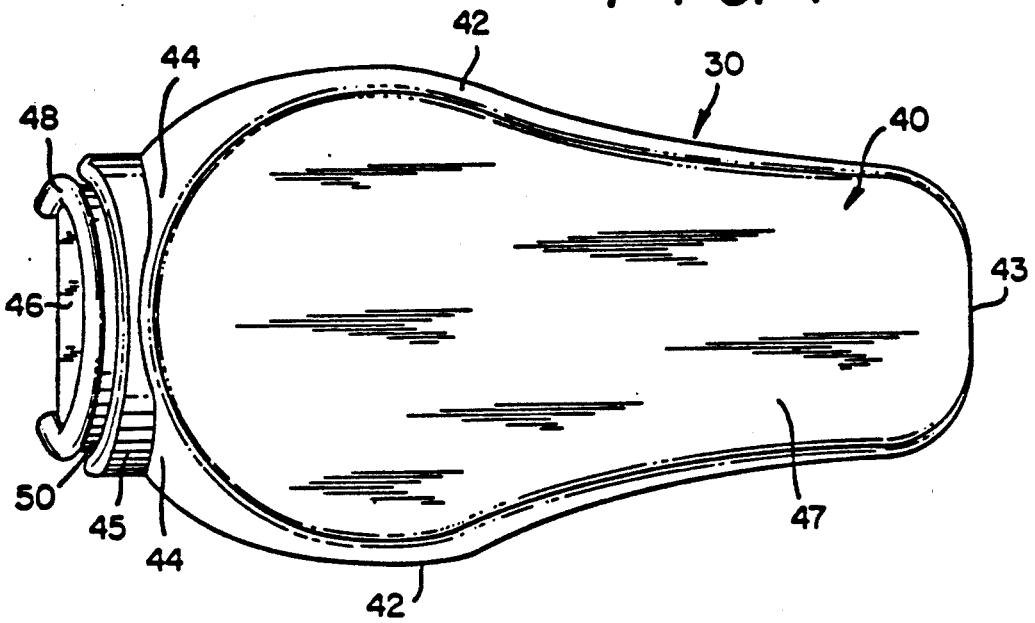
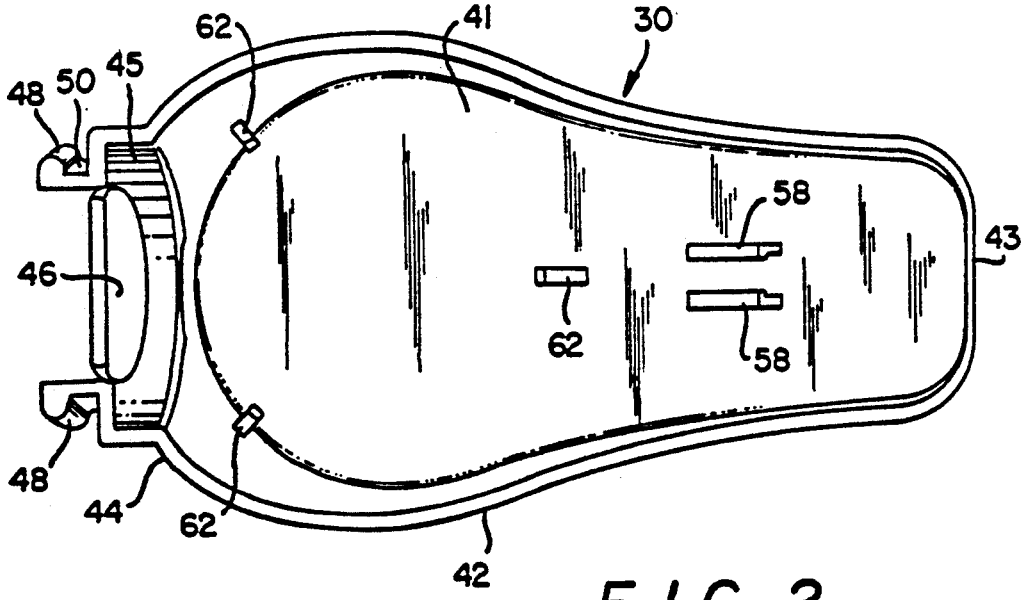
FIG. 2

FIG. 3
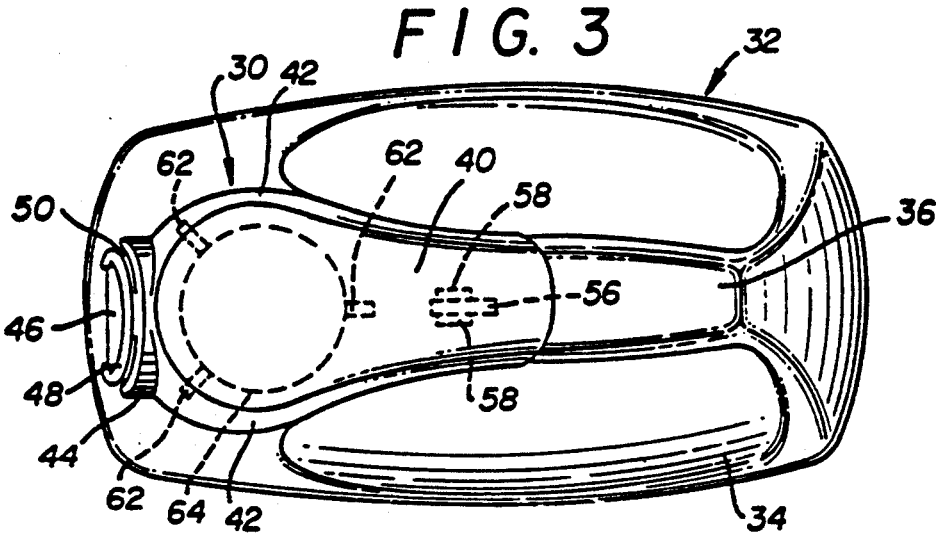
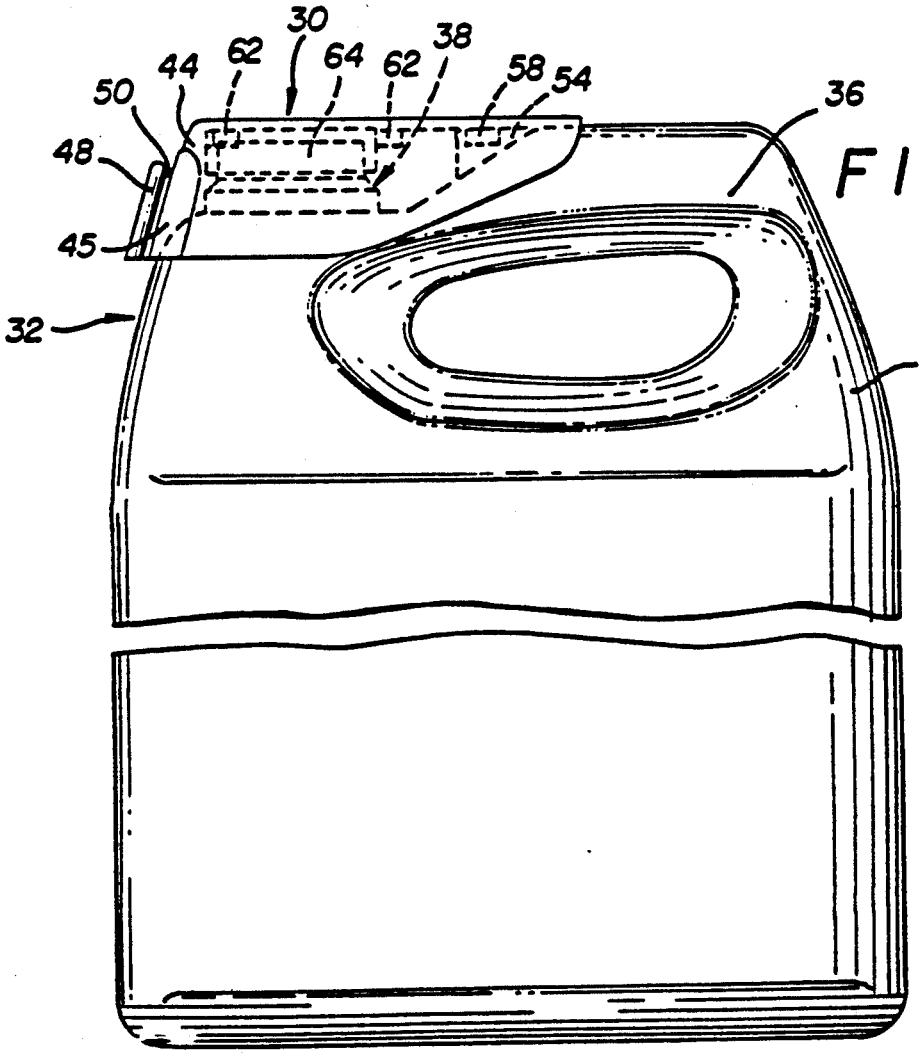
FIG. 4

FUNNEL AND INTEGRATED FUNNEL/CONTAINER PACKAGE

The ease of use of consumer products is often an important factor in the commercial success of the product. Many products are shipped in containers from which the product must be removed prior to use by the consumer. When the product is a flowable product, such as a particulate mass or a liquid, the common means for sale of the product is to provide the product in a container having an opening from which the product may be poured. A common problem with such containers is associated with the spillage that occurs when the product is removed from the container. This spillage problem is particularly acute when the product is poured from the container into another vessel having a relatively small opening or when access to the vessel receiving the product is in some way restricted whereby it is difficult to access the opening to the vessel.

The aforementioned pouring problem is well known in the art as evidenced by the historically accepted practice of employing funnels of various designs to improve the transfer of a flowable medium from its container to another vessel or container. Representative of various funnel designs for use with a container are the funnels disclosed in U.S. Pat. Nos. 133,683, 2,580,811, 2,735,594, 2,786,606 and 3,708,092.

U.S. Pat. No. 133,683 discloses a screw-on spout for a container of the type commonly found today on oil and gas containers. As shown in FIG. 2 of the patent, the pour spout is screwed onto the outside of the opening of the container.

U.S. Pat. No. 2,735,594 discloses a pour spout attachment for a carton. The pour spout is placed on the outer surface of the carton with the pour spout placed adjacent an opening in the carton. U.S. Pat. No. 2,786,606 discloses a liquid container with a pull-down dispensing spout.

U.S. Pat. Nos. 2,580,811 and 3,708,092 disclose detachable spouts for containers. In both patents the spouts are placed on the outside of the container opening adjacent the base of the container opening. Although these detachable spouts are useful, they are both necessarily subject to spillage and dripping during and after use. Since the spout is affixed to the outside of the container's opening, the contents remaining in the spout after use of the container tends to drip down the outside of the container when the container is placed in its normally upright position. The resulting mess associated with excess product on the outside of the container is unacceptable to the user in that product may come in contact with the user and, further, additional "clean-up" steps are then required to remove product from the outside of the container (and possibly the user). In addition, U.S. Pat. No. 3,708,092 discloses the detachable spout in combination with the container to provide a package for a liquid or particulate solid. Such a package (comprising a container and funnel) is advantageous for consumer sales in that it provides the funnel with the product in a convenient single sale item.

Although the package of U.S. Pat. No. 3,708,092 is convenient in that the container and funnel are provided as a single package, the form of the funnel and the means for securing the funnel to the container are not ideally suited for consumer products. Two distinct problems are associated with the funnel and related package disclosed in U.S. Pat. No. 3,708,092. Although the package is innovative in its conception, the use of a funnel affixed during use to the outside base of the container opening tends to result in spillage of the product on the outside of the container and can result in a dribbling effect as product runs down the side of the container as the container is inverted after use. Further, U.S. Pat. No. 3,708,092 does not disclose fastening means for securing the funnel to the container during pre-sale shipment of the product or the period when the funnel is not in use. Presumably, the package, as sold, would require an outer plastic wrap or an adhesive tape to secure the funnel to the container to form the overall package.

The instant invention overcomes the problems encountered in the prior art by providing a funnel adapted to be placed inside the opening of a container (or "container opening") and in a further embodiment provides fastening means associated with the funnel and the container for securing the funnel to the container to form an integrated package for use in the sale of flowable products.

DESCRIPTION OF THE FIGURES

FIG. 1 is a bottom view of the funnel alone;

FIG. 2 is a plan view of the funnel alone;

FIG. 3 is a top plan view of the container and funnel;

FIG. 4 is a side view of the container with the funnel as shown in FIG. 3 showing the container, container opening and the removable closure on the container opening in broken lines;

DESCRIPTION OF THE INVENTION

Figure 5:
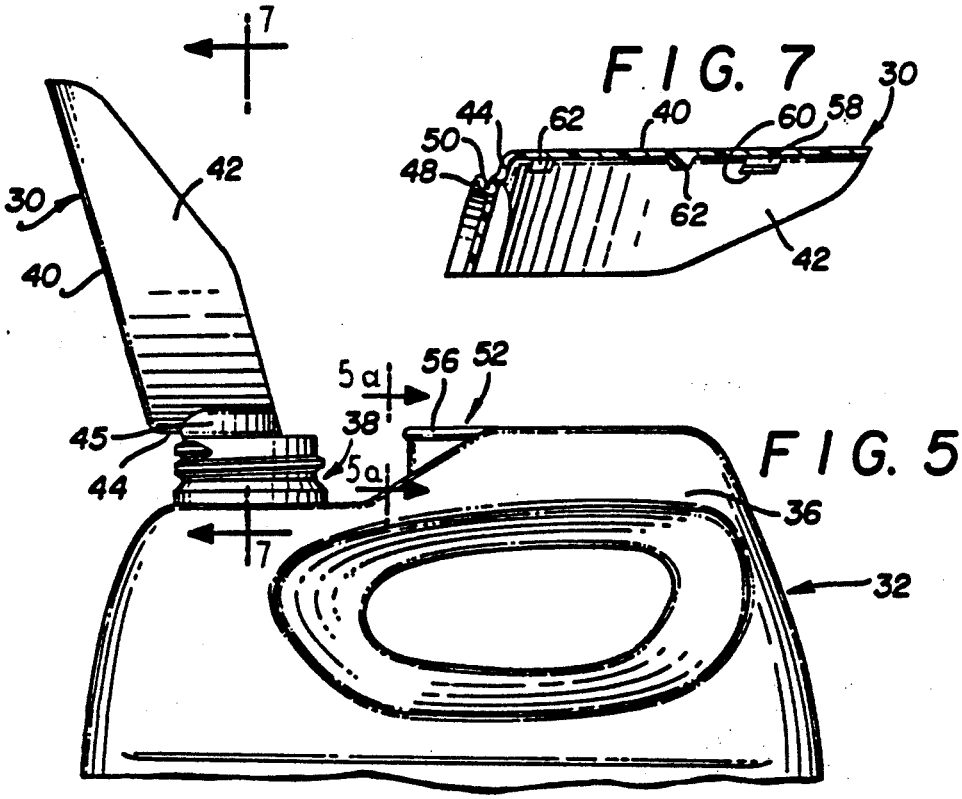
FIG. 5 is a partial side view of the container with the funnel overlaying the container opening and container handle.

The invention is directed to a novel funnel for use in the removal, i.e., pouring, of a flowable medium from a container. The funnel is formed to provide improved characteristics during use with a container having an opening via which its contents are removed. Further, in one embodiment the funnel and container are constructed to become securedly affixed whereby the funnel fits over, i.e., overlays, the handle and the container opening to form an integrated package, whereby the funnel is conveniently stored prior to first use and may be conveniently stored when not in use. Further, the instant funnel is easily used by simply removing the funnel from the container (e.g., simple "snap-on" and "snap-off" fastening means), removing a perforated portion (if present) in the rear wall and insertion of the funnel into the container opening.

In one embodiment the container opening has been modified from conventional design to have an inwardly projecting peripheral portion, i.e., a lip, for use in engaging a groove of the funnel, as discussed hereinafter. Further, the funnel and container are advantageously provided with mating fastening means, i.e., are designed to engage in a secure manner whereby the funnel is removably affixed to the container. Further, in one embodiment the funnel is provided with funnel alignment means whereby the funnel is aligned upon the container to form an integrated package by providing tabs or other alignment means to orient the funnel with respect to the removable closure for the container opening.

The invention generally relates to a funnel of generally U-shaped cross-section for use with a container having a container opening via which its contents are removed. The funnel of this invention comprises:

(a) a base portion;

(b) sidewalls interconnecting along two sides of said base portion;

(c) a rear wall portion having an inner surface and an outer surface interconnecting said side walls and said base portion, said rear wall portion having an opening or a removable portion for providing an opening; and (d) an engagement projection adjacent said outer surface of said rear wall portion adapted to engage the inner surface of a container opening.

The above-described funnel is distinguished from the prior art by being characterized by a resiliently deformable engagement projection adjacent the outer surface of the rear wall portion for insertion into a container opening. Since the funnel will typically be formed by injection molding or thermal forming, the engagement projection is typically an extension of the rear wall and not a separate piece of member affixed to the funnel.

By providing a funnel with a resiliently deformable engagement projection for insertion into a container opening, several practical advantages are realized that were heretofore not found in prior art funnels. The inner surface of the funnel over which the flowable medium travels is in direct flow communication with the inner surface of the container opening. This direct flow communication with the funnel's inner surface and the container opening minimizes spillage of the flowable medium onto the outside of the container when the container is returned to its normally vertical position after use. Flowable medium present on the inner surface of the funnel will flow into the container via the container opening (under gravity), contacting the inner surface of the funnel and the inner surface of the container opening. Further, alignment and securing of the engagement projection of the funnel to the inner surface of the container opening provides improved securement of the funnel to the container opening. This is to be contrasted to that obtained by fitting a cut out portion of a funnel around the base of a container opening, e.g., such as that disclosed in U.S. Pat. No. 3,708,092.

Since the instant funnel will typically be formed from a resilient material, typically a resilient plastic material, the instant funnel will be easily inserted into the container opening by applying pressure to the sidewalls of the funnel, whereby a slight inward deformation of the rear wall portion and engagement projection of the funnel occurs whereby the engagement projection is easily inserted into the container opening. As the pressure applied to the sidewalls is released the opening in the rear wall and the engagement projection return to their original position, i.e., substantially the position before pressure was applied to the sidewalls. When the size (outside diameter(s)) of the engagement projection is properly proportioned in relation to the internal diameter of the container opening the outer surface(s) of the engagement projection tightly presses against the inside surface(s) of the container opening. In one embodiment an internal rib/groove surface is provided inside the container opening as a result of the container opening being fitted with a screw-on removable closure. A screw-on removable closure typically engages the container opening via a spiral rib on the outer surface of the container opening. The internal rib/groove referred to above may be formed as a result of the existence of a complimentary inner surface for the container opening resulting from use of the screw-on closure, since in normal blow molding processes the inner surface will typically be a rib/groove arrangement formed as a result of the use of a screw-on closure. In a further embodiment, the container may be provided with a specific groove on the inner surface of the container for engaging a groove in the projection of the funnel. Further, when the funnel is affixed to the container by aligning a groove associated with the funnel's engagement projection the container opening may be provided with an inwardly projecting portion, i.e., a lip, at the mouth of the container opening. The aforementioned embodiments involve contacting the surfaces of the engagement projection and the inner surface of the container opening for securing the funnel to the container. The contacting surfaces may be selected to be greater than that disclosed for use of a funnel affixed in the manner shown in U.S. Pat. No. 3,708,092. Further, the actual contacting surfaces of the funnel/container resulting from affixing the funnel by placement of the base of the funnel inside the opening of the container are not in direct contact with the flowable medium during use of the funnel.

In a further aspect of applicant's invention the aforementioned funnel is provided with a shape suitable for overlying the handle of a container and the container opening with associated removable closure. Further, the funnel is provided with fastening means for engaging fastening means on the container to form an integrated package for a flowable material, i.e., a flowable particulate solid or liquid medium. Further, funnel alignment means may be provided on the inner surface of the funnel for engaging the periphery of the removable closure, i.e., cap, for the container opening when the funnel is placed in an overlying fashion on the container. In this embodiment the package for a flowable material comprises:

(a) a container comprising at one end thereof a handle, at another end thereof a container opening having an inside surface, a removable closure for said container opening and having container fastening means adapted to engage funnel fastening means; and (b) a funnel removably overlying said handle and said removable closure and generally conforming to the configuration of said handle and removable closure, said funnel having a generally U-shaped cross section and comprising:

(i) a base portion;

(ii) sidewalls interconnecting along two sides of said base portion;

(iii) a rear wall portion having an inner surface and an outer surface interconnecting said sidewalls and said base portion, said rear wall portion having an opening or a removable portion for providing an opening;

(iv) an engagement projection adjacent the outer surface of said rear wall portion adapted to engage the inner surface of said container opening;

(v) funnel fastening means for engaging container fastening means; and (vi) optionally, alignment means for aligning the funnel in relation to said removable closure for the container opening.

Although not required, the container opening is typically circular in design and, accordingly, the opening or removable area in the rear wall portion is circular or semi-circular. Other geometric shapes may be employed for the container opening with a corresponding modification being made in the shape of the engagement projection and/or opening in the rear wall portion so as to correspond to the container opening. Further, the relative size of the engagement projection is selected to provide a sung, substantially fluid tight contact when placed adjacent the inside of the container opening to engage the inner surface(s) and/or an inwardly projecting lip portion of the container opening. The need for fluid-tight contact is substantially lessened by the fact that the flowable medium will tend to flow along a direct line of communication during use of the funnel.

The "fastening means" for affixing the funnel to the container comprise "funnel fastening means" and corresponding "container fastening means," and may be selected from a wide range of interlocking fastening means. The selection of the funnel fastening means and container fastening means relates primarily to their providing adequate securement of the funnel to the container. In addition the fastening means are selected to have an appropriate occlusion force so as to easily disengage, i.e., to permit easy removal and attachment of the funnel from and to the container by the user. The funnel fastening means and the container fastening means may be of most any design, including conventional rib and groove design, e.g., as disclosed in U.S. Pat. Nos. 2,978,769; 3,416,199; 3,338,285; Re. 28,969; 4,212,337; 4,362,198; and 4,516,268. Incorporated herein by reference. The actual selection of the fastening means (the respective funnel fastening means and the container fastening means) is a matter of choice with the desired opening and closing forces of the fastening means and the overall package design being factors to be considered in making the selection. Although not preferred, the funnel may be secured to the container by adhesives, velcro-type fastening means and the like. A particularly well-suited design for the funnel fastening means and the container fastening means will be discussed hereinafter in relation to the Figures.

The funnel is advantageously formed from a resilient material, typically a plastic material, characterized by the ability to undergo physical deformations and return to substantially the same form after cessation of the physical deformation. The funnel of the instant invention may be formed of any material capable of being fashioned into the form of the funnel, as herein described, including the numerous formable metals, e.g., aluminum, and the many plastic materials useful for the molding, injection molding and thermal forming. The funnel will typically be formed from one or more thermoplastic materials owing to their low cost and the ease of use of such materials in manufacturing the instant funnels by injection molding or thermal forming. Representative thermoplastic materials include: the various polymers of ethylene with one or more comonomers, generally referred to as polyethylene polymers; polypropylenes; polybutylenes; polyesters; nylons; and mixtures thereof.

A further understanding of the instant invention is provided by reference to the drawings, although such are not intended to be limiting of the instant invention.

FIG. 1 is a bottom view of funnel 30 and FIG. 2 is a plan view of funnel 30 having base portion 40, sidewalls 42, front portion 43 and rear wall portion 44. Rear wall portion 44 has an opening (not shown) or a removable cut-out portion 46 which upon removal forms an opening in rear wall portion 44. The funnel has a generally U-shaped cross-section, having inner base surface 41 and outer base surface 47. Adjacent outer base surface 47 of rear wall portion 44 is an engagement projection 48 for engaging the inner surface of the inside surface of a container opening (to be discussed in conjunction with FIG. 5, below). As shown in FIG. 1, a groove 50 may be provided as part of engagement projection 48 to improve securement of the engagement projection 48 with the inside surface of the container opening and is characterized as being a groove adapted for mating with lip or rib extending inwardly from the inside surface of the container opening or preferably an inwardly extending lip along the periphery of the mouth of the container opening. The engagement projection 48 and the groove 50 are contiguous with the contoured portion 45 of the rear wall 44, and all of the foregoing constitute a lateral extension of the rear wall. Since the container opening will typically have a spirally formed outer rib/groove arrangement for a screw-on type removable closure, there will typically be an alternating spirally formed rib/groove arrangement on the inside of the container opening. In one embodiment an inwardly extending lip at the mouth of the container opening may be provided to engage groove 50, as discussed hereinafter in relation to FIG. 10. Groove 50 will securedly engage an inside rib (e.g., shown as lip 68 in FIG. 10 or an inwardly extending rib if present) of the container opening to provide a securing means whereby the funnel is affixed to the container for use in pouring a flowable medium from the container.

In a further embodiment, referring to FIG. 3 and FIG. 4. funnel 30 (as described above with reference to FIG. 1 and FIG. 2) is provided in conjunction with a container 32 having a top portion 34 formed with a handle 36 and container opening 38. The generally U-shaped funnel 30 of this invention is provided for pouring a flowable medium (liquid or particulate solid) from container 32. As above discussed, funnel 30 comprises base portion 40, sidewalls 42 and rear wall portion 44. The rear wall portion 44 is shown in FIG. 3 as having a removable cut-out portion 46 which is typically an area defined by a perforated border which may be easily removed, i.e., pushed out, to form an opening in rear wall portion 44 through which the flowable medium will pass during use of the funnel. It is advantageous to provide funnel 30 with a removable cut-out portion 46 rather than merely an opening, since debris will be prevented from collection within the area between funnel 30 and the container 32 when the combined funnel/container, i.e., package, is shipped. This feature is also beneficial in preventing the need to use a covering wrap, e.g., a shrink wrap, to prevent debris becoming lodged in the area between funnel 30 and container 32.

The shape of the removable cut-out portion 46 is preferably of semi-circular shape, and the opening formed by removing the cut-out 46 is of a size so as to permit an appropriate flow of the flowable medium. Further, the cut-out portion 46 is related to the overall dimensions of engagement projection 48 which in turn is selected to be of a size whereby the outer surface of engagement projection 48 securedly engages the inner surface of container opening 38. As aforementioned, a groove 50 may be present as a functional aspect of engagement projection 48 to provide a rib-groove engagement between an inner spiral rib or an inwardly extending lip of container opening 38. The actual shape and contours of rear wall portion 44 are not critical so long as rear wall portion 44 connects the sidewalls and base portion, has an opening or removable cut-out portion (i.e., an area defined by breakable perforations) for forming an opening and has adjacent thereto an engagement projection for securedly engaging the inner surface of the container opening. Rear wall portion 44 shown in FIG. 4 shows the contoured portion 45 extending outwardly before inwardly extending toward removable portion 46 and engagement projection 48.

Figure 7:
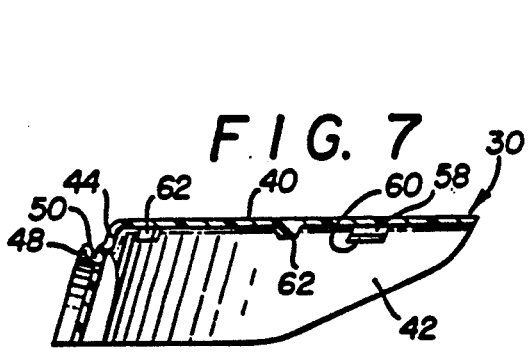
FIG. 7 is a cross-sectional view of the funnel taken along Line 7—7 of FIG. 5.
Figure 8:
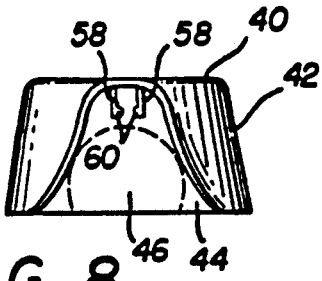
FIG. 8 is a front view of the funnel.
Figure 9:
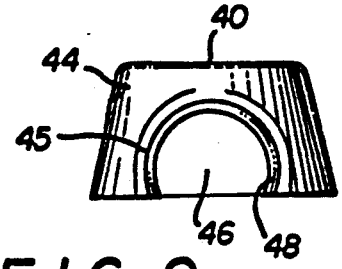
FIG. 9 is a rear view of the funnel.

Funnel 30 will have a generally U-shaped cross-section and will generally be made to conform to the shape of the area comprising the removable closure for the container opening and the handle of the container so as to overlay the removable closure and handle as shown in FIG. 3 and FIG. 4. Funnel 30 is advantageously secured to the container by fastening means present on both funnel 30 and container 32. The funnel fastening means and container fastening means depicted in FIG. 3 and FIG. 4 (in phantom) is better understood by reference to FIGS. 2 and 5–10. Container 32 is provided with a "T-shaped" container fastening means 52 having a base portion 54 and top portion 56 for snap-on engagement as the male member for mating with female funnel fastening means comprising parallel arms 58 and inwardly facing portions 60 (FIG. 8) on the inner surface of the funnel. The funnel fastening means comprises two substantially parallel arms 58 extending from the inner surface of the funnel with portions 60, each portion 60 inwardly extending towards the other to provide a "snap-on" feature in relation to the "T-shaped" container fastening means 52. Container fastening means 52 is engaged by arms 58 and portions 60 as funnel 30 is affixed to container 32 in an overlying relationship, as shown in FIG. 3 and FIG. 4. Although related to the particular design of container 32, in a design as shown in FIG. 5 it may be advantageous to overall aesthetic design to have the funnel fastening means slanted in relation to the slant of the handle of container 32 to provide improved fit. FIG. 7 depicts such a slanted funnel fastening means wherein the slant is selected to compliment the slant of handle 36.

As is readily apparent, the funnel fastening means on the inner surface of funnel 30 will come into contact with the contents of the container and preferably are designed to be of a size and shape that minimizes obstruction of the flowable medium during pouring. In addition, it may be advantageous to provide flow directing fins or ribs (not shown) on the inner surface of funnel 30 to direct and thereby improve the flow of the flowable medium over the inner surface of funnel 30.

Figure 6:
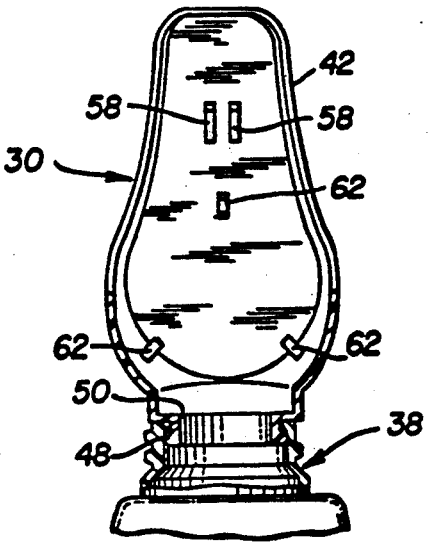
FIG. 6 is a bottom view of one embodiment of the funnel.

In a further embodiment proper, secure and improved alignment of funnel 30 on container 32 is achieved by providing one or more alignment means (shown as alignment tabs 62) which may be provided on the inner surface of funnel 30 for engaging removable closure 64 of container 32 at its periphery. FIG. 2, FIG. 3 and FIG. 6 depict funnel alignment means as comprising three (3) alignment tabs 62 extending from the inner surface of funnel 30. The spatial relation of alignment tabs 62 to removable closure 64 is such that the alignment tabs function to inhibit movement of funnel 30 in relation to the fixed position of removable closure 64 on container 32. Although a single alignment tab 64 in tight physical contact with removable closure 64 will be beneficial, it is preferred to employ two or more, preferably three alignment tabs approximately equidistantly spaced about the periphery of removable closure 64. The placement of three (3) tabs in this fashion provides alignment means effective in inhibiting the movement of funnel 30 in substantially all directions, except the up and down movement of funnel 30 in its placement on and removal from container 32.

Figure 10:
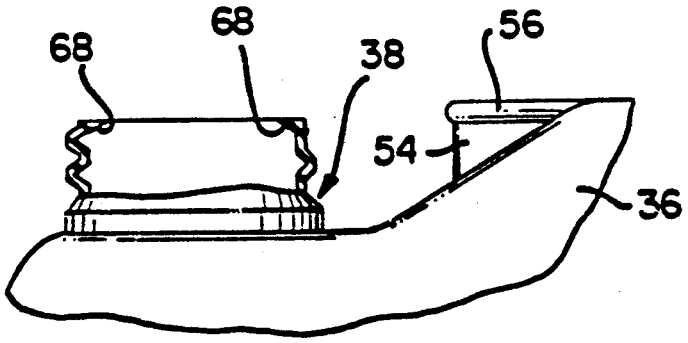
FIG. 10 is a cross-sectional view of a container opening having an inwardly projecting lip.

Use of funnel 30 is achieved by removing funnel 30 from its overlying position with respect to handle 36 and removable closure 64 of container 32. After removal of funnel 30 from container 32 the funnel and container are separate and distinct. If a removable portion 46 has been provided in rear wall portion 44, it should be removed by detachment along the perforated edge of the removable portion 46 whereby an opening is provided in rear wall portion 44. The flowable medium in the container will be removed from container 32 when container 32 is tilted so as to cause its contents to be displaced through container opening 38. Funnel 30 is inserted into container opening 38, i.e., removable closure 64 has been removed, such that the outer surface of the engagement projection 48 is placed in contact with at least a portion of the inner surface of container opening 38. FIG. 5 and FIG. 6 depict the relationship of funnel 30 and container 32 where engagement projection 48 has been placed inside container opening 38 so as to engage groove 50 with an inwardly extending rib or lip. FIG. 10 shows an inwardly extending lip 68 at the mouth of container opening 38 in secure engagement with groove 50 of funnel 30. The actual placement of funnel 30 is relatively simple, since funnel 30 will be formed from a resiliently deformable material e.g., a polyethylene. The opening in rear wall portion 44 provides as open area into which sidewall 42 and engagement projection 48 may be deformed and inwardly displaced by external pressure, i.e., by squeezing the outside surface of sidewalls 42 of funnel 30 between the user's fingers. This inward displacement results in a decrease in the effective diameter of the opening in rear wall portion 44 and engagement projection 48 and allows for placement of engagement projection 48 into container opening 38. Release of the pressure applied to sidewalls 42 results in return to substantially the original size of the opening in rear wall portion 44 and a return to substantially the initial positions of sidewalls 42 and engagement projection 48. Since the outer diameter of engagement projection 48 has been selected to correspond to the inner diameter of container opening 38 (or may be selected to be somewhat larger) the result is that funnel 30 is firmly held in place by the resilient nature of the material forming funnel 30 when the pressure on sidewalls 42 is released.

Figure 5A:
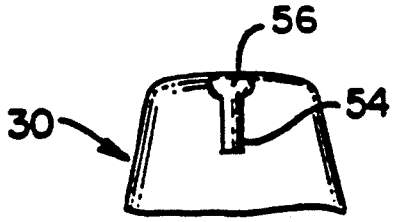
FIG. 5*a* is a cross-section taken along Line 5*a*—5*a* of FIG. 5 showing funnel fastening means.

FIG. 7 is a cross-sectional view of funnel 30 taken along line A of FIG. 5 showing base portion 40, sidewall 42, rear wall portion 44, engagement projection 48, groove 50, one-half of the funnel fastening means showing arm portion 58 with inwardly extending portion 60 and alignment tab 62. As shown in FIG. 7 (as well as in FIG. 5 and FIG. 4) sidewall 42 of funnel 30 typically has a downwardly tapering front edge with the taper beginning at about the middle of the funnel length. FIG. 5*a* is a cross-sectional view taken along Line B of FIG.

5 to show the "T-shaped" configuration of the container fastening means comprising base member 54 and top member 56. FIG. 10 is a cross-sectional view of container 32 showing container opening 38 with an inwardly extending lip 68 for engagement of groove 50 (not shown) as hereinbefore discussed.

I claim:

1. An improved package for a flowable material, the package being of the type which includes a container for the material and a funnel which is both detachably mountable to the exterior of the container to form a contoured, integrated package and removably attachable to an opening of the container to aid in pouring the material from the container and out of the opening; wherein the improvement comprises:

(a) a first surface irregularity on the inner surface of the container opening; and (b) the funnel having a scoop configuration with a U-shaped cross-section and being made of a resilient material, the funnel having (i) a rear wall with a U-shaped opening therethrough, (ii) a U-shaped extension which is continuous with the rear wall and has a U-shaped passageway therethrough which communicates with the rear wall opening, and (iii) a second surface irregularity on the exterior surface of the extension, the second irregularity being complementary in size and contour to the first surface irregularity when the funnel is in its normal, undeformed state;

the arms of the U of the funnel being deformable towards each other to decrease the respective effective areas of the rear wall opening, the passageway, and the second irregularity to permit essentially unhindered insertion of the extension into the container opening; following such insertion, the funnel returning to its normal state due to its resiliency to effect complementary engagement between the surface irregularities and to form a material-tight seal therebetween, which engagement locks the extension within the container opening and the funnel to the container for pouring the material.

2. A package as set forth in claim 1, which further comprises:

means within the scoop of the funnel and on the exterior of the container for detachably mounting the funnel to the container so as to overlie the container opening.

3. A package as set forth in claim 2, which further comprises:

a selectively removable closure for the container opening, and a handle formed integrally with the container;

the funnel partially encompassing a portion of the handle when the funnel overlies the container opening and the closure in place thereon.

4. A package as set forth in claim 3, which further comprises:

means within the funnel for engaging the closure when the funnel overlies the container opening to align the funnel with the container opening and the handle.

5. A package as set forth in claim 3, wherein:

the handle is partially encompassed by a forward portion of the funnel which is remote from the rear wall opening; and which further comprises:

a cut-out which is removably mounted in and blocks the rear wall opening prior to initial use of the funnel, the mounted funnel, with the cut-out in place and with the handle partially encompassed, covering and enclosing the region of the container in the vicinity of the container opening with the closure in place thereon when the funnel overlies such opening to exclude dirt and debris from such region.

6. A package as set forth in claim 2, which further comprises:

a cut-out, which is removably mounted in and blocks the rear wall opening prior to initial use of the funnel, the mounted funnel with the cut-out in place, covering and enclosing the region of the container in the vicinity of the container opening, when the funnel overlies such opening, to maintain such region clean, detachment of the funnel from the container and removal of the cut-out permitting the deformation of the rear wall opening and the flow of the material into the funnel.

7. A package as set forth in claim 1, wherein:

the second surface irregularity includes an engagement projection which is formed on and extends about the periphery of the extension.

8. A package as set forth in claim 1 wherein:

the second surface irregularity includes a peripheral groove which is formed in and extends about the periphery of the extension.

9. A package as set forth in claim 1, wherein:

the second surface irregularity comprises an engagement projection which is formed on, and a peripheral groove which is formed in, the extension, both the projection and the groove extending about the periphery of the extension.

10. A package as set forth in claim 1, which further comprises:

a cut-out removably mounted in and blocking the rear wall opening prior to initial use of the funnel, removal of the cut-out permitting the deformation of the rear wall opening and flow of the material into the funnel.

11. A package for flowable material, comprising:

(a) an upright container having a top with a handle thereon, a spout which defines an opening through the top remote from the handle, and a removable closure for the spout and the opening;

(b) a funnel removably mountable to the top to overlie the handle and the closure, the funnel having a U-shaped cross-section and comprising (i) a base, (ii) sidewalls extending along and connected to the base, (iii) a rear wall connected to the sidewalls and the base, the rear wall having an outer lateral extension and a selectively removable portion, removal of which portion provides a passageway through the rear wall of the extension communicating with the funnel, and (iv) a feature on the lateral extension which is engageable with the inside surface of the spout;

(c) T-shaped means on the top of the container and parallel arm means with facing projections within the funnel for snapping together to selectively secure the funnel in the overlying relationship with the handle and the closure; and (d) means on the funnel for engaging the periphery of the removable closure to align the funnel therewith when the funnel is secured in the overlying relationship with the handle and the closure.

12. A package according to claim 11, wherein:

the removable closure is circular.

* * * * *